US006736684B2

(12) United States Patent
Ishiyama

(10) Patent No.: US 6,736,684 B2
(45) Date of Patent: May 18, 2004

(54) TERMINAL FITTING AND METHOD OF FORMING IT

(75) Inventor: Takayuki Ishiyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/442,539

(22) Filed: May 21, 2003

(65) Prior Publication Data

US 2003/0220015 A1 Nov. 27, 2003

(30) Foreign Application Priority Data

May 24, 2002 (JP) ..... 2002-150962

(51) Int. Cl.[7] ..... H01R 11/22
(52) U.S. Cl. ..... 439/852
(58) Field of Search ..... 439/843, 842, 439/851, 852, 595

(56) References Cited

U.S. PATENT DOCUMENTS 5,788,542 A * 8/1998 Miwa ..... 439/851
6,019,646 A * 2/2000 Okamura et al. ..... 439/852
6,428,365 B1 * 8/2002 Yamamoto ..... 439/849

FOREIGN PATENT DOCUMENTS

JP 2002-15803 6/2002

* cited by examiner

*Primary Examiner*—Tho D. Ta
(74) *Attorney, Agent, or Firm*—Anthony J. Casella; Gerald E. Hespos

(57) ABSTRACT

A female terminal fitting (F) has a resilient contact piece (23) with first and second leaf springs (24, 29) connected by a folded portion (26). A base end (24A) of a first leaf spring (24) and an extending end (30) of a second leaf spring (29) are supported on a base plate (14). Thus, a high contact pressure can be ensured. The folded portion (26) enables the resilient contact piece (23) to be short along forward and backward directions. Additionally, the extending end of the first leaf spring (24) and the base end of the second leaf spring (29) are coupled via the closely folded portion (26). Thus, an elevation difference between the first and second leaf springs (24, 29) is small.

18 Claims, 7 Drawing Sheets

TERMINAL FITTING AND METHOD OF FORMING IT

BACKGROUND OF THE INVENTION

1. Field of the Invention

The invention relates to a terminal fitting.

2. Description of the Related Art

Japanese Unexamined Patent Publication No. 2002-15803 discloses a terminal fitting with front and rear ends. A rectangular tube is formed at the front end of the terminal fitting. A resilient contact piece is folded back at an angle from the front end of the bottom plate of the rectangular tube and is substantially surrounded by the rectangular tube. A male tab can be inserted into the rectangular tube and is held tightly between the tip of the resilient contact piece and the ceiling plate of the rectangular tube. The extending rear end of the resilient contact piece is supported on the bottom plate at front and rear points to ensure a sufficient contact pressure between the resilient contact piece and the male tab.

The above-described terminal fitting is formed continuously with front and rear angularly aligned leaf spring portions. The resilient contact piece is long along forward and backward directions and makes the rectangular tube long. As a result, the entire terminal fitting is large.

Consideration has been given to shortening the terminal fitting by folding the resilient contact piece into a substantially U-shape along its length. Thus, the two leaf spring portions could be arranged one over the other. However, such a construction causes an elevation difference between the two leaf spring portions due to the U-shaped fold. This leads to a problem of increasing the height of the rectangular tube and that of the entire terminal fitting.

The invention was developed in view of the above problems, and an object thereof is to miniaturize a terminal fitting in which a resilient contact piece is supported at two points in a rectangular tube.

SUMMARY OF THE INVENTION

The invention is directed to a terminal fitting with a resilient contact piece that can be brought resiliently into contact with a male tab. The resilient contact piece comprises a first leaf spring with a base end supported on a base plate. A folded portion is folded at the extending end of the first leaf spring toward the base plate. A second leaf spring extends from the folded portion substantially toward the base end of the first leaf spring and has the extending end held substantially in contact with the base plate at least during the resilient contact of the resilient contact piece with the male tab.

The first and second leaf springs of the resilient contact piece are folded at an acute angle to each other. The length of the resilient contact piece along forward and backward directions is shorter than that of a resilient contact piece in which two leaf springs meet at an angle greater than 90°. Further, the second leaf spring is between the first leaf spring portion and the base plate. However, the extending end of the first leaf spring and the base end of the second leaf spring are coupled via the folded portion. Thus, an elevation difference between the extending end of the first leaf spring and the base end of the second leaf spring is small as compared to a resilient contact piece in which two leaf springs are coupled via a substantially U-shape fold, and the height of the resilient contact piece can be reduced by this reduced elevation difference. Therefore, the terminal fitting advantageously can be miniaturized with respect to both forward and backward directions and a height direction.

The resilient contact piece extends substantially along forward and backward directions and is surrounded by a substantially rectangular tube. The male tab can be inserted into the rectangular tube from the front and is held resiliently between a first plate of the substantially rectangular tube and the resilient contact piece.

The folded portion preferably is folded closely.

The first leaf spring preferably extends substantially forward and the male tab contacts the extending end of the first leaf spring. This contact position of the resilient contact piece with the male tab is near the front end. Thus, the length of the male tab can be shortened accordingly.

The folded portion preferably extends oblique to an inserting direction of the male tab. Thus, the leading end of the male tab is guided to a proper contact position by the inclination of the closely folded portion.

The base end of the first leaf spring preferably extends at an angle from a side plate of the substantially rectangular tube that is not connected with the base plate, and a locking edge is formed at a lateral edge of the base end of the first leaf spring.

A locking plate preferably extends at an angle from a lateral edge of the base plate that faces and is substantially parallel to the side plate. The locking plate is substantially continuous with the lateral edge of the base plate.

The locking plate preferably has a locking hole that engages the locking edge to prevent the base end of the first leaf spring from being lifted.

The base plate preferably is formed with a raised portion, and the outer surface of the base end of the first leaf spring portion preferably is held substantially in contact with the raised portion.

The base end of the first leaf spring is prevented from vertically shaking by being brought into contact with the raised portion of the bottom plate and having the locking edge thereof engaged with the locking hole.

The base end of the first leaf spring preferably contact the raised portion on the bottom plate. Thus, the locking edge and the upper edge of the locking hole are higher than the bottom plate. Accordingly, the locking edge and the locking hole engage each other on a flat part of the locking plate above the quadrantal section that defines a boundary between the bottom plate and the locking plate. Thus, even if the locking edge and the locking hole are engaged over a distance equal to the thickness of the locking plate, the locking edge does not bulge out from the outer surface of the locking plate.

The base plate may be formed with a fastening hole engageable with a resin lock in a housing to prevent the terminal fitting from coming out when the terminal fitting is inserted into the housing.

The extending end of the second leaf spring engages a resin lock in a housing when the resilient contact piece is in contact with the male tab to prevent the terminal fitting from coming out. Thus, an area of engagement of the resin lock with the terminal fitting is wider than a case where a resin lock engages only a fastening hole. Therefore, an external force on the terminal fitting in withdrawing direction is dispersed across the resin lock.

The resilient contact piece preferably comprises a guiding surface for guiding a contact of the resilient contact piece with the male tab.

These and other objects, features and advantages of the invention will become more apparent upon reading the following detailed description and accompanying drawings. Even though embodiments are described separately, single features may be combined to additional embodiments.

BRIEF DESCRIPTION OF THE DRAWINGS

FIG. 6(*b*) is a partial lateral section of a modification.

DETAILED DESCRIPTION OF THE PREFERRED EMBODIMENTS

Figure 1:
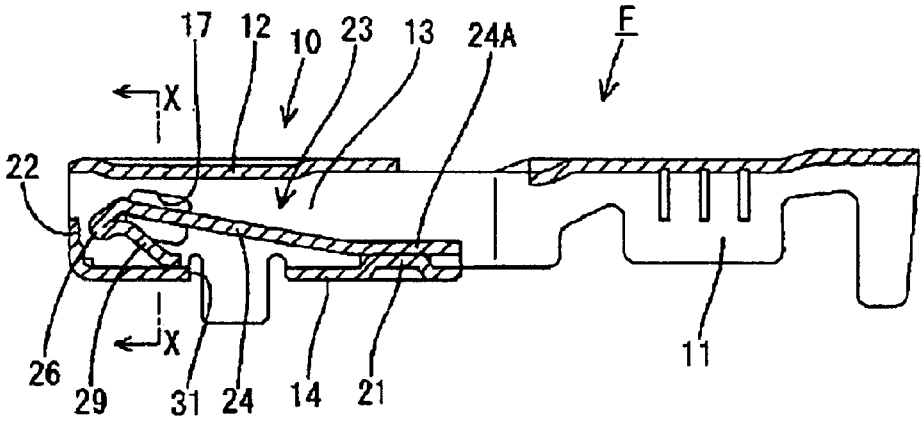
FIG. 1 is a longitudinal section of a terminal fitting according to one embodiment of the present invention.
Figure 2:
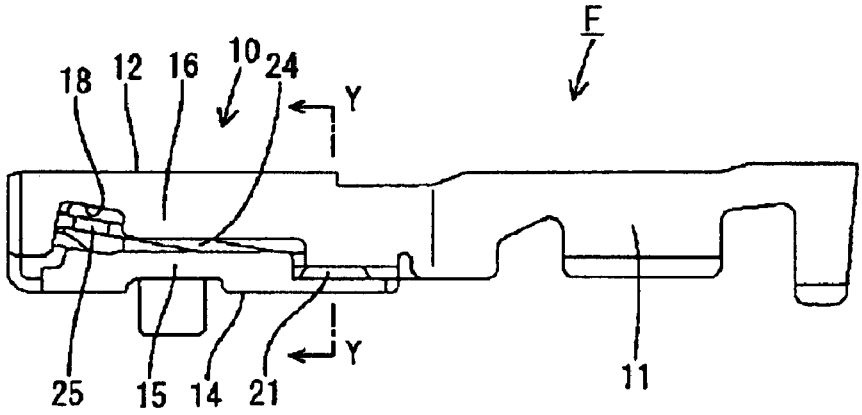
FIG. 2 is a left side view of the terminal fitting.
Figure 3:
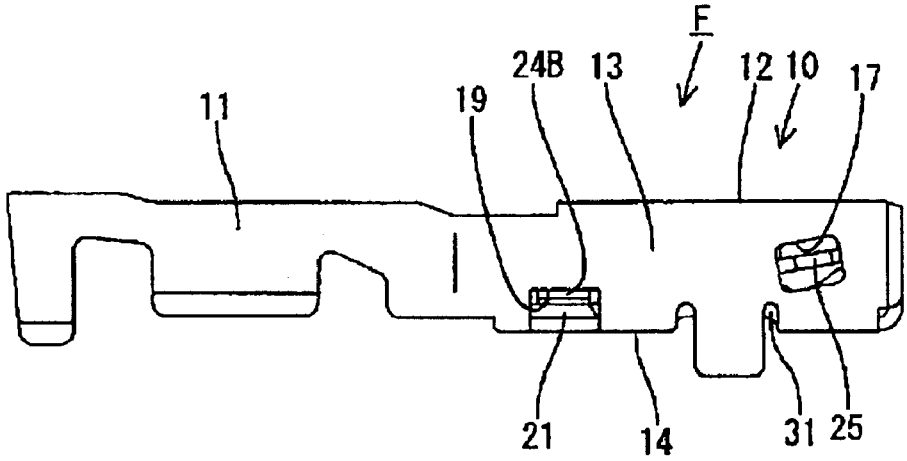
FIG. 3 is a right side view of the terminal fitting.
Figure 4:
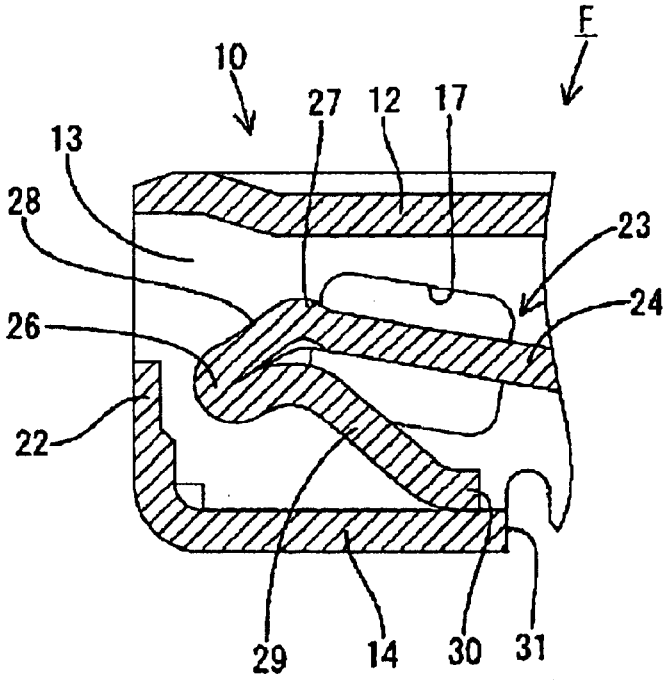
FIG. 4 is a partial enlarged view of FIG. 1.
Figure 5:
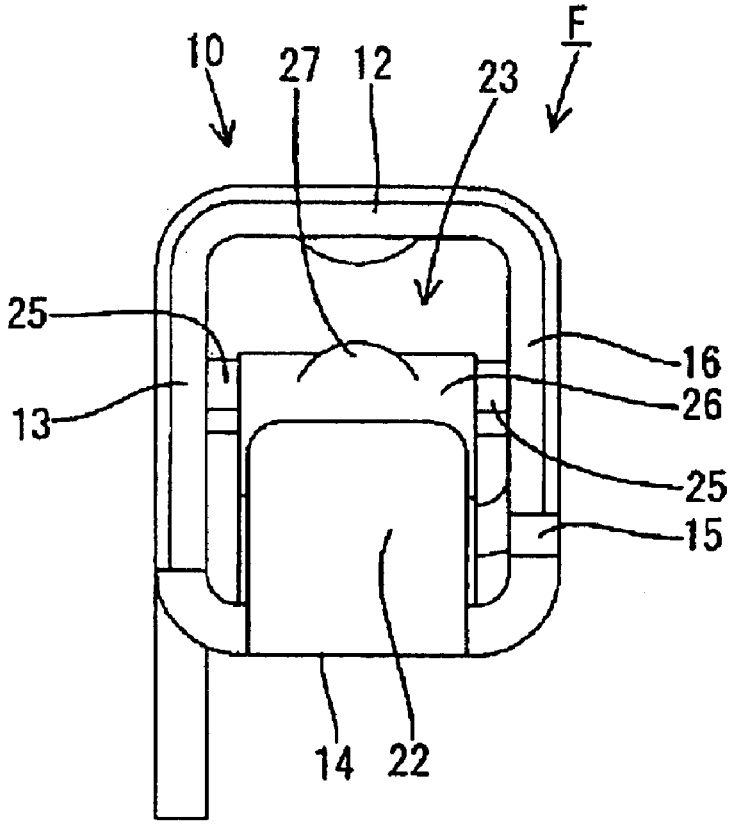
FIG. 5 is a front view of the terminal fitting.

A terminal fitting according to the invention is identified by the letter F in FIGS. 1 to 9. A side of the terminal fitting F that is connectable with a mating connector (left side in FIG. 1) is referred to as the front side herein.

The female terminal fitting F is narrow and long in forward and backward directions, and has opposite front and rear ends. A front portion of the terminal fitting F defines a substantially rectangular tube 10 that is hollow along forward and backward directions. The female terminal fitting F is mounted in a female housing 40 that is a mating partner of a male housing 50. A male tab T is mounted in the male housing 50 and can be inserted into the rectangular tube 10 when the housings 40 and 50 are mated. A rear portion of the terminal fitting F has open barrels that define a wire crimping portion 11. The wire crimping portion 11 is crimped, bent or folded into electrical connection with an end of a wire (not shown). Alternatively or additionally, the rear end of the female terminal fitting F may be connected with the end of the wire by insulation displacement, soldering, welding or the like.

The rectangular tube 10 has a ceiling plate 12 that is narrow and long along forward and backward directions. The rear end of the ceiling plate 12 is substantially continuous with the wire-crimping portion 11. A long narrow locking plate 13 extends orthogonally down from the right edge of the ceiling plate 12 and a long narrow bottom plate 14 extends left at right angles from the bottom edge of the locking plate 13. A long narrow lower plate 15 extends up a short distance from an area of the left edge of the bottom plate 14 excluding its rear end, and a side plate 16 extends down at substantially at a right angle from the left edge of the ceiling plate 12. The bottom edge of the side plate 16 is stepped so that there is a small clearance to the upper edge of the lower plate 15 and the left edge of the rear end of the bottom plate 15. Right-angled portions extend between the above-described plates of the rectangular tube 10. Further, an excessive deformation preventing hole 17 is formed in the front end of the locking plate 13, and an excessive deformation preventing space 18 corresponding to the excessive deformation preventing hole 17 is formed at the front end of the clearance between the side plate 16 and the lower plate 15.

A bottom end of a rear end portion of the locking plate 13 is cut off to form a locking hole 19. An upper area substantially continuous with the bottom plate 14 of the locking hole 19 is in a flat portion of the locking plate 13. On the other hand, a lower area of the locking hole 19 is in a quadrantal boundary 20 between the locking plate 13 and the bottom plate 14.

An area of the bottom plate 14 adjacent the locking hole 19 is embossed up to define a raised pedestal 21. An elevation difference between the upper surface of the raised pedestal 21 and the upper surface of the bottom plate 14 substantially equals the thickness of the bottom plate 14. A protecting plate 22 extends up at substantially right angles from the front edge of the bottom plate 14.

A long narrow resilient contact piece 23 is accommodated in the rectangular tube 10 and has a rear end supported on the rectangular tube 10. Thus, the rectangular tube 10 surrounds the resilient contact piece 23. The male tab T can be inserted into the rectangular tube 10 from the front and is pressed resiliently between the lower surface of the ceiling plate 12 and a contact portion 27 of the resilient contact piece 23 by a resilient force of the resilient contact piece 23. As a result, the female terminal fitting F and the male tab T are connected electrically with a specified contact pressure. The resilient contact piece 23 is comprised of a first leaf spring 24, a closely folded portion 26 and a second leaf spring 29.

The base end 24A of the first leaf spring 24 extends rightward at right angles from the bottom edge of the rear end of the side plate 16, and is a substantially rectangular flat plate that is substantially parallel with the bottom plate 14. An extending edge of the base end 24A from the side plate 16 serves as the locking edge 24B. The base end 24A of the first leaf spring 24 is held in contact with the raised pedestal 21 of the bottom plate 14 from above, and the locking edge 24B engages the upper edge of the locking hole 19 from below. Thus, the base end 24A of the first leaf spring 24 is prevented from vertical shaking. The right end surface of the locking edge 24B is substantially flush with or slightly receded inward from the outer surface of the locking plate 13. Thus, a dimension of an area of engagement of the locking edge 24B and the locking hole 19 along a transverse direction is substantially equal to the thickness of the locking plate 13.

The first leaf spring 24 is substantially planar and extends obliquely up to the front, and the extending front end thereof is at the front end of the rectangular tube 10. Two excessive deformation preventing pieces 25 project out from the left and right edges of the extending end of the first leaf spring 24, and are located in the excessive deformation preventing hole 17 and the excessive deformation preventing space 18. When the first leaf spring 24 is displaced excessively down or up along the deformation direction, the excessive deformation preventing pieces 25 contact the edge of the excessive deformation preventing hole 17 and the bottom edge of the side plate 16 or the upper edge of the lower plate 15 to prevent displacement of the first leaf spring 24 beyond its resiliency limit.

The closely folded portion 26 is substantially continuous with the extending end of the first leaf spring 24. The closely folded portion 26 extends obliquely down to the front from the extending end of the first leaf spring 24, and is folded closely back at its extending end toward the bottom plate 14, and then obliquely up to the back. The closely folded portion 26 may be folded back either without any space enclosed or having a small space enclosed between its folded portions.

The base end of the closely folded portion 26 and the extending end of the first leaf spring 24 meet at an angle when viewed sideways. The angled meeting defines a contact 27 for the male tab T. The contact 27 is spaced from the ceiling plate 12 by a distance that is less than the thickness of the male tab T when the resilient contact piece 27 is in an unbiased condition. The upper surface of the closely folded portion 26 is substantially continuous with the contact 27 and defines a slanted guiding surface 28 that extends oblique to an inserting direction of the male tab T into the rectangular tube 10. The protecting plate 22 of the bottom plate 14 is below the slanted guiding surface 28, and at a height to conceal the second leaf spring 29.

The second leaf spring 29 is continuous with the extending end of the closely folded portion 26. The second leaf spring 29 is a flat plate and extends substantially obliquely down to the back from the extending end of the closely folded portion 26. Accordingly, the extending end of the closely folded portion 26 and the front end of the second leaf spring 29 meet at an angle. The extending end of the second leaf spring 29 defines a fastening portion 30 that is bent into substantially parallel alignment with the bottom plate 14. The fastening portion 30 contacts the upper surface of the bottom plate 14 when the male tab T does not contact the resilient contact piece 23. Accordingly, the resilient contact piece 23 is supported on the bottom plate 14 at the base end 24A of the first leaf spring 24 and the fastening portion 30 of the second leaf spring 29. This two-point supporting construction ensures that the resilient restoring force of the resilient contact piece 23 achieves a high contact pressure when the male tab T contacts resilient contact piece 23.

The second leaf spring 29 is shorter than the first leaf spring 24 and is inclined by a larger angle to the bottom plate 14 than the first leaf spring 24. Thus, the fastening portion 30 of the second leaf spring 29 is more forward than the base end 24A of the first leaf spring 24. The bottom plate 14 is formed with a fastening hole 31 that extends between the fastening portion 30 of the second leaf spring 29 and the base end 24A of the first leaf spring 24. The fastening portion 30 of the second leaf spring 29 is slightly before the front edge of the fastening hole 31 when the resilient contact piece 23 is in the free state. However, the fastening portion 30 slides back on the bottom plate 14 to substantially the same position as the front edge of the fastening hole 31 when the resilient contact piece 23 is deformed due to contact with the male tab T.

The terminal fitting F is inserted into a cavity 41 of the female housing 40 from behind. A resin lock 42 is cantilevered forward in the cavity 41. The resin lock 42 is pushed by the bottom plate 14 of the rectangular tube 10 and is deformed resiliently down in the process of inserting the terminal fitting F. The resin lock 42 is restored resiliently and fits into the fastening hole 31 when the terminal fitting F reaches a proper insertion position. Thus, the front edge of the fastening hole 31 engages the resin lock 42 from the front to hold the terminal fitting F so as not to come out.

The male housing 50 is connected with the female housing 40 in this state. As a result, the male tab T enters the rectangular tube 10 and is pressed resiliently between the resilient contact piece 23 and the ceiling plate 12 to establish a connection. The resilient deformation of the resilient contact piece 23 causes the first leaf spring 24 to incline down with respect to its base end 24A in a direction to make an angle of inclination to the bottom plate 14 smaller. The displacement of the first leaf spring 24 causes the closely folded portion 26 to displace down toward the bottom plate 14 and causes the second leaf spring 29 to displace up with respect to the extending end of the closely folded portion 26. At this time, the height of the fastening portion 30 of the second leaf spring 29 varies by sliding on the bottom plate 14. Additionally, the end of the second leaf spring 29 that is connected with the closely folded portion 26 is displaced down and approaches the bottom plate 14 together with the closely folded portion 26. Thus, an angle of inclination of the second leaf spring 29 to the bottom plate 14 decreases. In this way, the resilient contact piece 23 undergoes resilient deformations at two points, namely, the base end 24A of the first leaf spring 24 and the end of the second leaf spring 29 connected with the closely folded portion 26. Thus, a sufficient contact pressure between the resilient contact piece 23 and the male tab T can be ensured by these resilient deformations at two points. The fastening portion 30 is engaged with the resin lock 42 in the contact state of the resilient contact piece 23 with the male tab T.

As described above, the first and second leaf springs 24, 29 of the resilient contact piece 23 are folded into an acute angle V-shape with respect to each other. Thus, the length of the resilient contact piece 23 along forward and backward directions is shorter than that of a resilient contact piece in which two leaf springs meet at an angle greater than 90°. Further, the second leaf spring 29 is between the first leaf spring 24 and the bottom plate 14, but the extending end of the first leaf spring 24 and the base end of the second leaf spring 29 are coupled via the closely folded portion 26. Thus, an elevation difference between the extending end of the first leaf spring 24 and the base end of the second leaf spring 29 is smaller than a resilient contact piece in which two leaf springs are coupled via a substantially U-shape folded portion, and the height of the resilient contact piece 23 can be reduced by this reduced elevation difference. As a result, the height of the rectangular tube 10 and that of the entire terminal fitting F can be reduced. Therefore, the terminal fitting F can be miniaturized with respect to both forward and backward directions and the height direction.

The first leaf spring 24 extends forward and the male tab T contacts the contact portion 27 at the extending end of the first leaf spring 24. Thus, the male tab T can be shortened.

The closely folded portion 26 extends oblique to the inserting direction of the male tab T and the upper surface of the closely folded portion 26 defines the slanted guiding surface 28. The slanted guiding surface 28 guides the leading end of the male tab T during the insertion of the male tab T. Furthermore, the slanted guiding surface 28 is formed at the closely folded portion 26, which is a double structured portion that has a high rigidity. Thus, the closely folded portion 26 is not deformed even if the male tab T strikes hard against it.

Figure 6A:
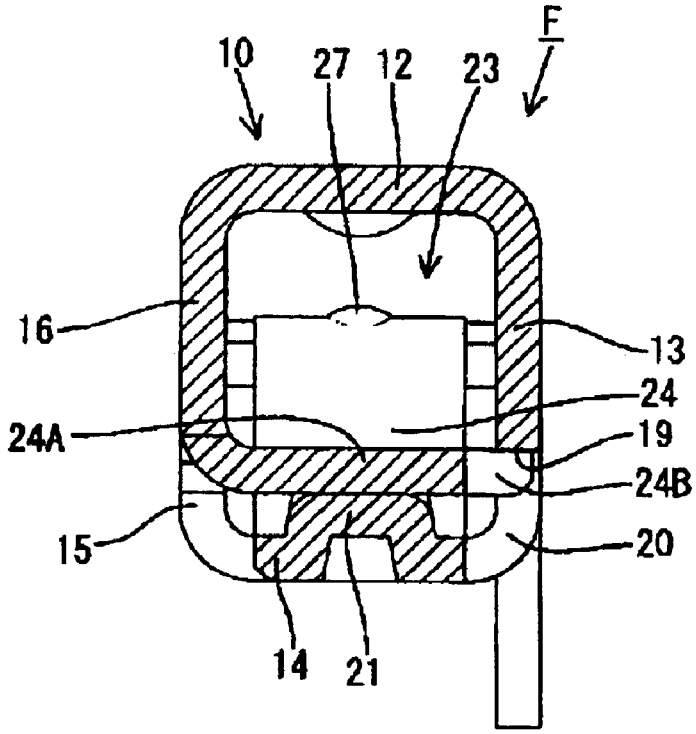
FIG. 6(*a*) is a lateral section along 6*a*—6*a* of FIG. 2.
Figure 6B:
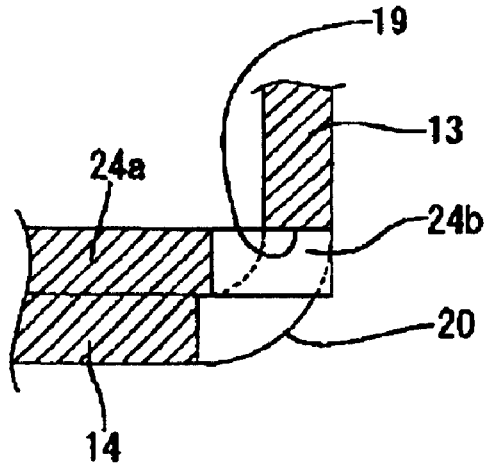
Figure 7:
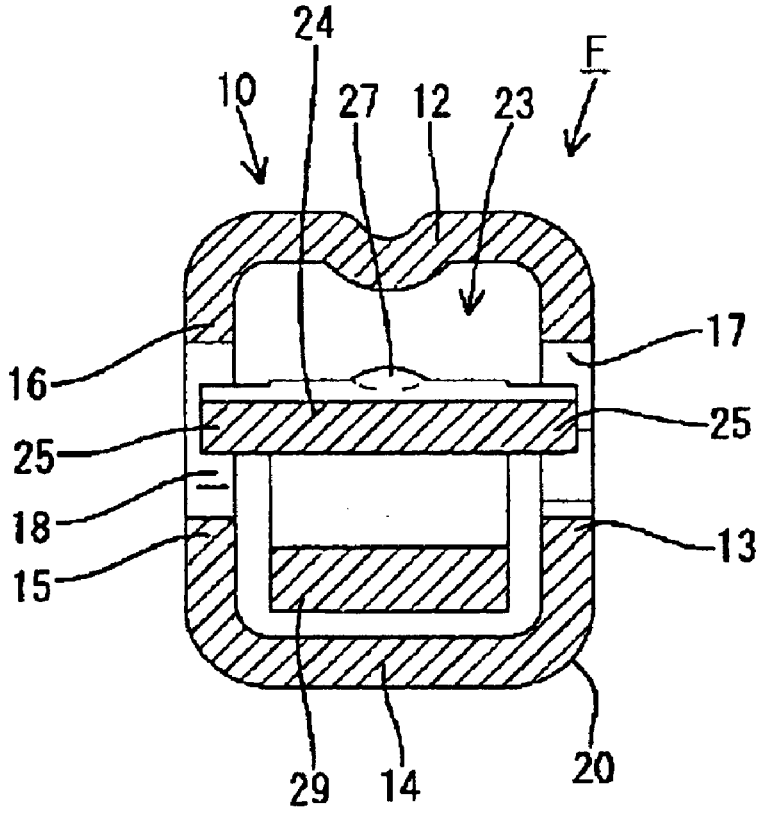
FIG. 7 is a section along 7—7 of FIG. 1.
Figure 8:
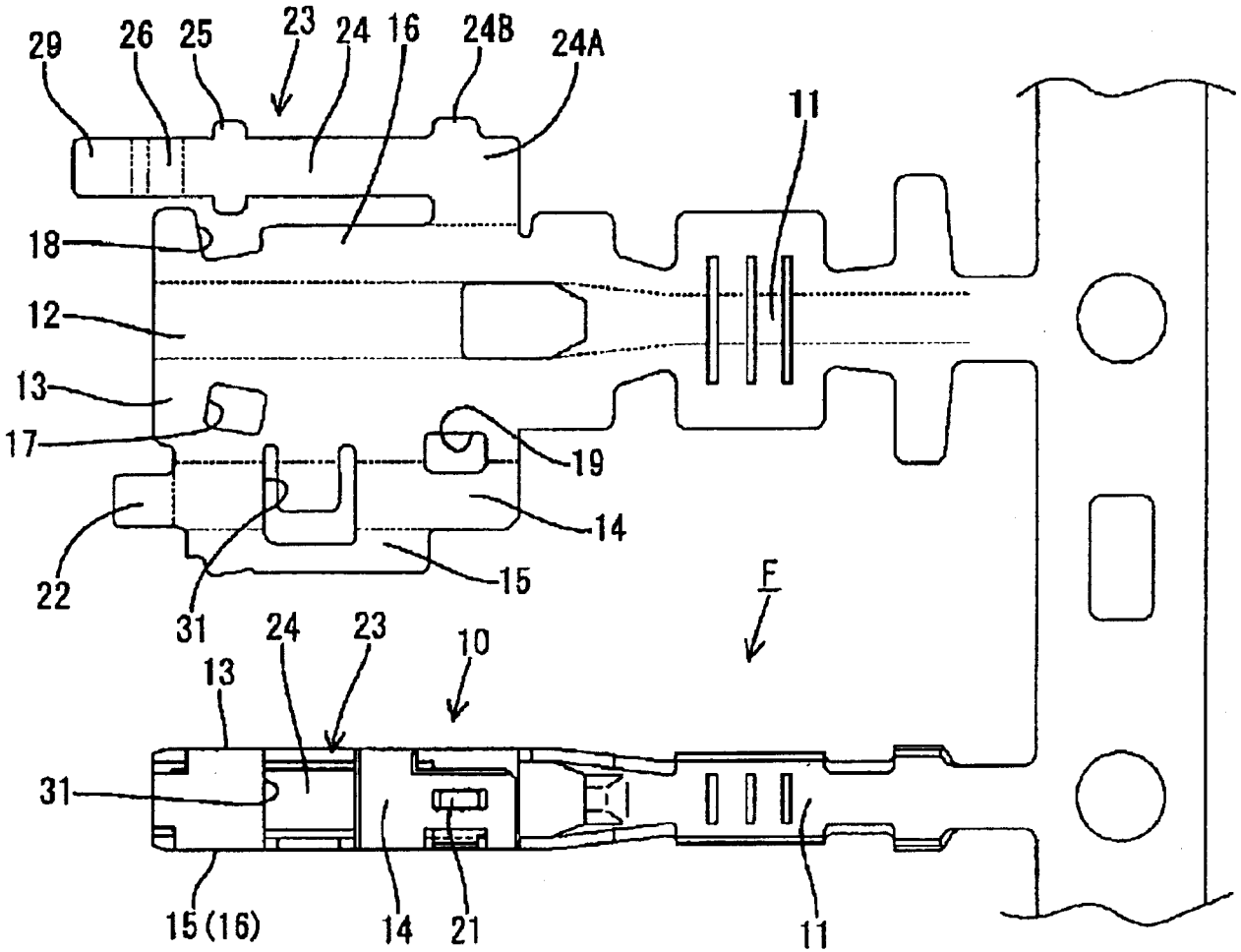
FIG. 8 is a plan view showing a development of the terminal fitting.
Figure 9:
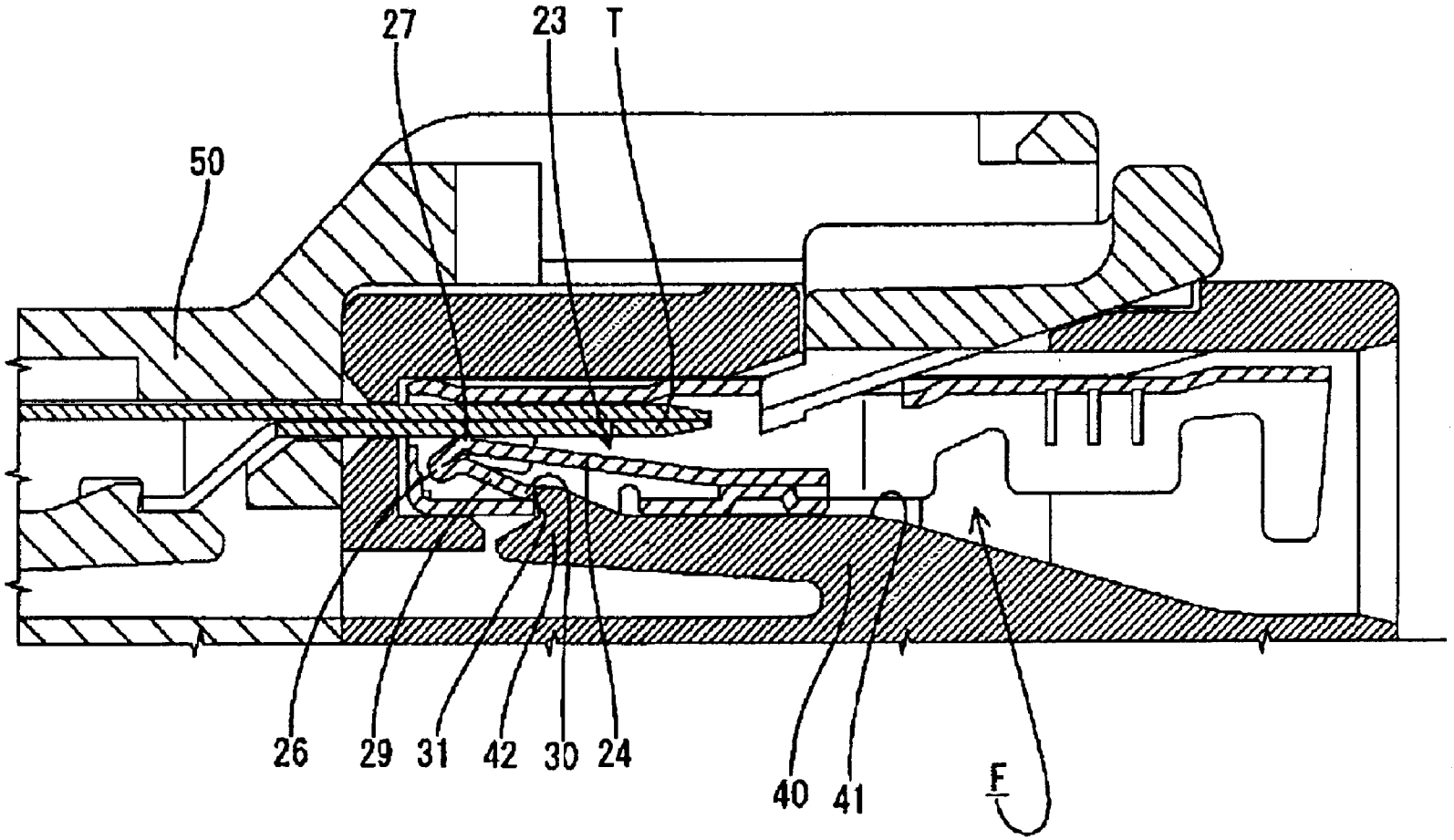
FIG. 9 is a longitudinal section showing a state where the terminal fitting is inserted into a housing to be connected with a male tab.

The base end 24A of the first leaf spring 24 contacts the raised portion 21 of the bottom plate 14 and the locking edge 24B of the first leaf spring 24 engages the locking hole 19. Thus, the base end 24A of the first leaf spring portion 24 is prevented from vertically shaking. The raised pedestal 21 is higher than the upper surface of the bottom plate 14. Additionally, the locking edge 24B is at substantially the same height as the base end 24A and the height of the upper edge of the locking hole 19 to be engaged with the locking edge 24B are higher than the bottom plate 14. Specifically, the locking edge 24B and the locking hole 19 engage each other at a position above the quadrantal portion 20 that defines the boundary between the bottom plate 14 and the locking plate 13 and at a position in the substantially flat part of the locking plate 13. In contrast, a bottom end 24*a* could contact the upper surface of the bottom plate 14 and a locking edge 24*b* could engage the locking hole 19 at the same height as the quadrantal portion 20, as shown in FIG. 6(*b*). In such a construction, the bottom edge of the locking edge 24*b* would bulge out from the outer surface of the quadrantal portion 20 and hence out from the rectangular tube 10 if the locking edge 24*b* and the locking hole 19 were to engage maximally over a distance equal to the thickness of the locking plate 13. Contrary to this, the raised portion 21 at the bottom plate 14 of the subject invention ensures that the locking edge 24B is above the quadrantal portion 20, as shown in FIG. 6(*a*). Thus, even if the locking edge 24B and the locking hole 19 engage over a maximal distance equal to the thickness of the locking plate 13, the locking edge 24B does not bulge out from the outer surface of the rectangular tube 10. Further, the edge near the quadrantal portion 20 is rounded and does not bulge out from the rectangular tube 10.

The terminal fitting F is inserted in the female housing 40 and the resilient contact piece 23 is held resiliently in contact with the male tab T. In this condition, both the front edge of the fastening hole 31 and the fastening portion 30 at the extending end of the second leaf spring 29 contact the resin lock 42. Thus, the fastening portion 30 and the front edge of the fastening hole 31 are substantially continuous with each other, are substantially one over the other and are held substantially flush with each other (see FIG. 9). Accordingly, as compared to a case where a resin lock is engaged only with a fastening hole, an area of engagement of the resin lock 42 with the terminal fitting F is vertically larger. Therefore, when an external force is exerted on the terminal fitting F in withdrawing direction, a force pushing the resin lock 42 can be dispersed, thereby preventing the resin lock 42 from being damaged.

The present invention is not limited to the above described and illustrated embodiment. For example, the following embodiments also are embraced by the present invention as defined by the claims. Beside the following embodiments, various changes can be made without departing from the scope and spirit of the present invention as defined by the claims.

The extending end of the second leaf spring substantially contacts the bottom plate even when the male tab is not in contact with the resilient contact piece in the foregoing embodiment. However, the extending end of the second leaf spring may not be in contact with the bottom plate when the male tab is not in contact with the resilient contact piece, and may be brought into contact with the bottom plate when the male tab is inserted to resiliently deform the resilient contact piece.

The first leaf spring extends forward in the foregoing embodiment. However, it may extend backward from the front end of the bottom plate.

The extending end of the second leaf spring is an engaging section engageable with the resin lock in the foregoing embodiment. However, it may not be engaged with the resin lock according to the invention.

The extending end of the second leaf spring substantially slides on the bottom plate as the resilient contact piece is deformed resiliently in the foregoing embodiment. However, it may be fixed so as not to move along forward and backward directions according to the present invention.

The first leaf spring extends from the side plate and the bottom plate receives a contact pressure with the male tab. However, it may extend from the bottom plate and the bottom plate still may receive a contact pressure with the male tab.

The closely folded portion is oblique to the inserting direction of the male tab in the foregoing embodiment. However, it may be substantially parallel with the inserting direction of the male tab.

A part of the bottom plate is raised and the base end of the first leaf spring is supported on the raised portion in the foregoing embodiment. However, the raised portion may not be formed according to the invention.

What is claimed is:

1. A terminal fitting with a resilient contact piece at least partly surrounded by a substantially rectangular tube, the resilient contact piece being for resiliently contacting a male tab such that the male tab inserted into the rectangular tube is held between a first plate of the substantially rectangular tube and the resilient contact piece, the resilient contact piece comprising:

a first leaf spring having a base end supported on a base plate of the substantially rectangular tube and extending at an angle from a side plate of the substantially rectangular tube which is not connected with the base plate, the base end having a locking edge at a lateral edge of the base end, the first leaf spring further having an opposite extending end;

a folded portion folded toward the base plate from the extending end of the first leaf spring; and a second leaf spring extending from the folded portion substantially toward the base end of the first leaf spring, the second leaf spring having an extending end held in contact with the base plate at least during the resilient contact of the resilient contact piece with the male tab.

2. The terminal fitting of claim 1, wherein the folded portion is a closely folded portion.

3. The terminal fitting of claim 1, wherein the male tab is engageable with a contact of the first leaf spring near the extending end of the first leaf spring.

4. The terminal fitting of claim 1, wherein the folded portion extends oblique to an inserting direction of the male tab.

5. The terminal fitting of claim 1, wherein a locking plate extends at an angle from a lateral edge of the base plate and is substantially continuous with the lateral edge of the base plate.

6. The terminal filling of claim 1, wherein the locking plate is formed with a locking hole with which the locking edge is engaged to prevent the base end of the first leaf spring from being lifted.

7. The terminal fitting of claim 1, wherein the base plate is formed with a fastening hole engageable with a resin lock in a housing to prevent the terminal fitting from coming out when the terminal fitting is inserted into the housing.

8. The terminal fitting of claim 1, wherein the resilient contact piece comprises a guiding surface for guiding a contact of the resilient contact piece with the male tab.

9. A terminal fitting with a resilient contact piece for resiliently contacting a male tab, the resilient contact piece comprising:

a first leaf spring having a base end supported on a base plate of the terminal fitting and an opposite extending end, the base plate being formed with a raised portion, and the base end of the first leaf spring being held substantially in contact with the raised portion;

a folded portion folded toward the base plate from the extending end of the first leaf spring; and a second leaf spring extending from the folded portion substantially toward the base end of the first leaf spring, the second leaf spring having an extending end held in contact with the base plate at least during the resilient contact of the resilient contact piece with the male tab.

10. A terminal fitting with a resilient contact piece for resiliently contacting a male tab, the resilient contact piece comprising:

a first leaf spring having a base end supported on a base plate of the terminal fitting and having an opposite extending end;

a folded portion folded toward the base plate from the extending end of the first leaf spring; and a second leaf spring extending from the folded portion substantially toward the base end of the first leaf spring, the second leaf spring having an extending end held in contact with the base plate at least during the resilient contact of the resilient contact piece with the male tab, the extending end of the second leaf spring is being engageable with a resin lock in a housing to prevent the terminal fitting from coming out when the terminal fitting is inserted into the housing in a state where the resilient contact piece is resiliently in contact with the male tab.

11. A terminal fitting having opposite front and rear ends, a substantially rectangular tube formed adjacent the front end, the rectangular tube having a base plate, a ceiling plate opposed to the base plate and opposed first and second side plates extending between the ceiling plate and the base plate, a resilient contact piece in the rectangular tube, the resilient contact piece comprising:

a first leaf spring having a base end supported on the base plate and an opposite end extending obliquely toward the ceiling plate;

a folded portion (26) having a guiding panel extending obliquely toward the base plate from the extending end of the first leaf spring and a return panel extending from the guiding panel obliquely back towards the first leaf spring; and a second leaf spring extending from an end of the return panel obliquely toward the base plate, the second leaf spring having an extending end engageable with the base plate at a location forward of the base end of the first leaf spring.

12. The terminal fitting of claim 11, wherein the base end of the first leaf spring extends unitarily from a portion of the second side plate, and a locking edge being formed at a lateral edge of the base end of the first leaf spring and engaging a locking hole in the first side plate.

13. The terminal fitting of claim 12, wherein the base plate is formed with a raised portion, and the base end of the first leaf spring being held in contact with the raised portion.

14. The terminal fitting of claim 13, wherein the base plate is formed with a fastening hole between the base end of the first leaf spring and the extending end of the second leaf spring.

15. A connector comprising:

a housing formed with a cavity and a resilient lock projecting into the cavity; and a terminal fitting disposed in the cavity, the terminal fitting having opposite front and rear ends, a substantially rectangular tube formed adjacent the front end, the rectangular tube having a base plate, a ceiling plate opposed to the base plate and opposed first and second side plates extending between the ceiling plate and the base plate, a fastening hole formed in the base plate and engaged by the lock of the housing, a first leaf spring having a base end supported on the base plate rearward of the fastening hole and an opposite end extending obliquely toward the ceiling plate, a guiding panel extending obliquely toward the base plate at the extending end of the first leaf spring and a return panel extending from the guiding panel obliquely back towards the first leaf spring, and a second leaf spring extending from an end of the return panel obliquely toward the base plate, the second leaf spring having an extending end engageable with the base plate at a location forward of the engaging hole.

16. The connector of claim 15, wherein the extending end of the second leaf spring is engageable with the lock to prevent the terminal fitting from coming out of the housing.

17. A terminal fitting having a base plate and a resilient contact piece for resiliently contacting a male tab, the resilient contact piece comprising:

a first leaf spring having a base end supported on the base plate and an opposite extending end extending obliquely away from the base plate;

a closely folded portion folded towards the base plate from the extending end of the first leaf spring, the closely folded portion including a first panel extending from the extending end of the first leaf spring and a second panel extending from the first panel and closely folded into opposed relationship to the first panel; and a second leaf spring extending obliquely towards the base plate from the second panel of the closely folded portion, the second leaf spring having an extending end that contacts the base plate at least during resilient contact of the resilient contact piece with a male tab.

18. The terminal fitting of claim 17, wherein the first panel of the closely folded portion includes a guiding surface extending unitarily from the first leaf spring and facing obliquely away from the base plate for guiding the male tab towards the extending end of the first leaf spring.

* * * * *